US008713951B2

(12) United States Patent
Takayama et al.

(10) Patent No.: US 8,713,951 B2
(45) Date of Patent: May 6, 2014

(54) AIR CONDITIONING APPARATUS

(75) Inventors: Keisuke Takayama, Chiyoda-ku (JP); Yusuke Shimazu, Chiyoda-ku (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 178 days.

(21) Appl. No.: 13/263,754

(22) PCT Filed: May 8, 2009

(86) PCT No.: PCT/JP2009/058671
§ 371 (c)(1),
(2), (4) Date: Oct. 10, 2011

(87) PCT Pub. No.: WO2010/128553
PCT Pub. Date: Nov. 11, 2010

(65) Prior Publication Data

US 2012/0031605 A1 Feb. 9, 2012

(51) Int. Cl.
*G05D 23/30* (2006.01)

(52) U.S. Cl.
USPC ..... 62/202; 62/208

(58) Field of Classification Search
CPC ..... F25B 2341/068; F25B 49/00; F25D 29/00111
USPC ..... 62/202, 208, 129, 126, 159, 168, 156, 62/211, 513; 165/201, 205, 291
See application file for complete search history.

(56) References Cited

U.S. PATENT DOCUMENTS 5,050,396 A * 9/1991 Ohkoshi et al. ..... 62/160
5,297,392 A * 3/1994 Takata et al. ..... 62/160
5,344,069 A * 9/1994 Narikiyo ..... 236/49.3
5,467,604 A * 11/1995 Sekigami et al. ..... 62/117
2005/0005621 A1* 1/2005 Jayadev ..... 62/230

FOREIGN PATENT DOCUMENTS

| | | | |
|---|---|---|---|
| JP | 62-84241 | A | 4/1987 |
| JP | 2-251040 | A | 10/1990 |
| JP | 3-17475 | A | 1/1991 |
| JP | 06147675 | A | 5/1994 |
| JP | 2000-227242 | A | 8/2000 |
| JP | 2002013776 | A | 1/2002 |
| JP | 2004-53069 | A | 2/2004 |
| JP | 2006029694 | A | 2/2006 |

OTHER PUBLICATIONS

Translation of JP 6-147675 to Kazuhiko et al.*
Translation of JP 2006-29694 to Hideo.*

(Continued)

*Primary Examiner* — Mohammad M Ali
(74) *Attorney, Agent, or Firm* — Buchanan Ingersoll Rooney PC

(57) ABSTRACT

There are provided a plurality of use-side heat exchangers, inter-heat-medium heat exchangers, heat medium flow path switching devices, which switch flow paths, and pumps, which feed heat media to these paths; the inter-heat-medium heat exchangers heat or cool a heat medium by exchanging heat between the heat medium and a heat source fluid fed from a heat source apparatus. About half of the plurality of use-side heat exchangers are preheated or precooled, and the remaining use-side heat exchangers which are not preheated or precooled exchange heat media with use-side heat exchangers that have been preheated or precooled and that are not yet started to operate, suppressing energy consumed for preheating or precooling.

15 Claims, 8 Drawing Sheets

(56) References Cited

OTHER PUBLICATIONS

Office Action from Japanese Patent Office dated Jan. 22, 2013, issued in corresponding Japanese Patent Appln No. 2011-512284, with English translation thereof (6 pages).
Office Action (Decision of Rejection) dated Jul. 2, 2013, issued by the Japanese Patent Office in the corresponding Japanese Patent Application No. 2011-512284 and an English translation thereof. (5 pages).
International Search Report (PCT/ISA/210) issued on Aug. 11, 2009, by Japanese Patent Office as the International Searching Authority for International Application No. PCT/JP2009/058671.
Office Action (Notification of the First Office Action) issued on Sep. 9, 2013 by the Chinese Patent Office in corresponding Chinese Application No. 200980159196.6 and an English Translation of the Office Action. (7 pages).
Jan. 27, 2014 Chinese Office Action issued in Chinese Application No. 200980159196.6.

* cited by examiner (a)

REFRIGERANT FLOW
→ HEATING ONLY
⇢ COOLING ONLY (b)

REFRIGERANT FLOW
→ HEATING-MAIN OPERATION
⇢ COOLING-MAIN OPERATION

AIR CONDITIONING APPARATUS

TECHNICAL FIELD

The present invention relates to an air conditioning apparatus such as a multi-system air conditioner for a building.

BACKGROUND ART

Some air conditioning apparatus of the prior art use heat media (cold liquid and hot liquid) from a heat source apparatus (heat source facility) for heat exchange precools or preheats a heat medium circulated between a heat source unit and an indoor unit (air conditioning unit). An exemplary disclosed air conditioning apparatus activates a heat source apparatus at a time of day calculated on the basis of various types of data including the temperature of a liquid, measured at night, the liquid being included in a pipe connecting a heat source unit and air conditioning unit, after which the air conditioning apparatus fully opens a valve of an indoor unit scheduled to be operated on that day in a forcible manner, and precools or preheats the indoor unit before the indoor unit is actually used (see Patent Literature 1, for example).

CITATION LIST

Patent Literature

Patent Literature 1: Japanese Unexamined Patent Application Publication No. 2000-227242 (Abstract, FIG. 1)

SUMMARY OF INVENTION

Technical Problem

If many indoor units are scheduled to operate or an indoor unit scheduled to operate did not operate, a preheated (or precooled) heat medium is cooled (or heated) by natural heat dissipation (or heat absorption), wasting energy. Furthermore, if an attempt is made to achieve simultaneous operation of cooling and heating in which both an indoor unit operation for performing cooling operation and an indoor unit operation for performing heating operation are present, the indoor unit for heating may be precooled or the indoor unit for cooling may be preheated. Then, the outlet air temperature at the start of heating becomes low or the outlet air temperature at the start of cooling becomes high; the user thereby may lose comfort.

The present invention addresses the above problem and an object thereof is to obtain an air conditioning apparatus that can achieve simultaneous operation of heating and cooling by heating or cooling a heat medium with a heat source apparatus and allowing the heated or cooled heat source to pass through indoor units in such a way that preheating or precooling can be performed without energy being wasted.

Solution to Problem

An air conditioning apparatus according to the present invention includes a plurality of use-side heat exchangers, an inter-heat-medium heat exchanger that exchanges heat between a heat medium circulated in the use-side heat exchanger and a heat source fluid fed from a heat source apparatus, a heat medium feeding unit, temperature detecting means for detecting the temperature of the heat medium in a flow path that connects the inter-heat-medium heat exchanger and the use-side heat exchanger, temperature detecting means for detecting outside air temperature and a controller that controls the flow path of a heat medium. The controller, when the outside air temperature detected by the temperature detecting means is compared with a predetermined temperature at a preset preheating start time that is earlier than the estimated time that an indoor unit having the use-side heat exchanger starts operation and the outside air temperature is lower than the first predetermined temperature, preheats about half of the plurality of use-side heat exchangers by driving the heat medium feeding unit connected to a heat medium circulating circuit thereof to perform heat-up operation of the heat medium for the about half of the plurality of use-side heat exchangers and, when an operation for heating is commanded and a use-side heat exchanger which is commanded is not yet preheated, exchanges heat media between the commanded use-side heat exchanger and a use-side heat exchanger that has been preheated. The controller , when the outside air temperature detected by the temperature detecting means is compared with a second predetermined temperature at a preset precooling start time that is earlier than the estimated time that an indoor unit having the use-side heat exchanger starts operation and the outside air temperature is higher than the second predetermined temperature, precools about half of the plurality of use-side heat exchangers by driving the heat medium feeding unit connected to the heat medium circulating circuit to perform cool-down operation of the heat medium of the about half of the plurality of use-side heat exchangers and, when an operation for cooling is commanded and a use-side heat exchanger which is commanded is not yet precooled, exchanges heat media between the commanded use-side heat exchanger and a use-side heat exchanger that has been precooled.

Advantageous Effects of Invention

In the present invention, about half of a plurality of use-side heat exchangers are preheated or precooled, so an air conditioning apparatus that consumes less energy for preheating or precooling can be obtained.

DESCRIPTION OF EMBODIMENTS

Embodiment 1

Figure 1:
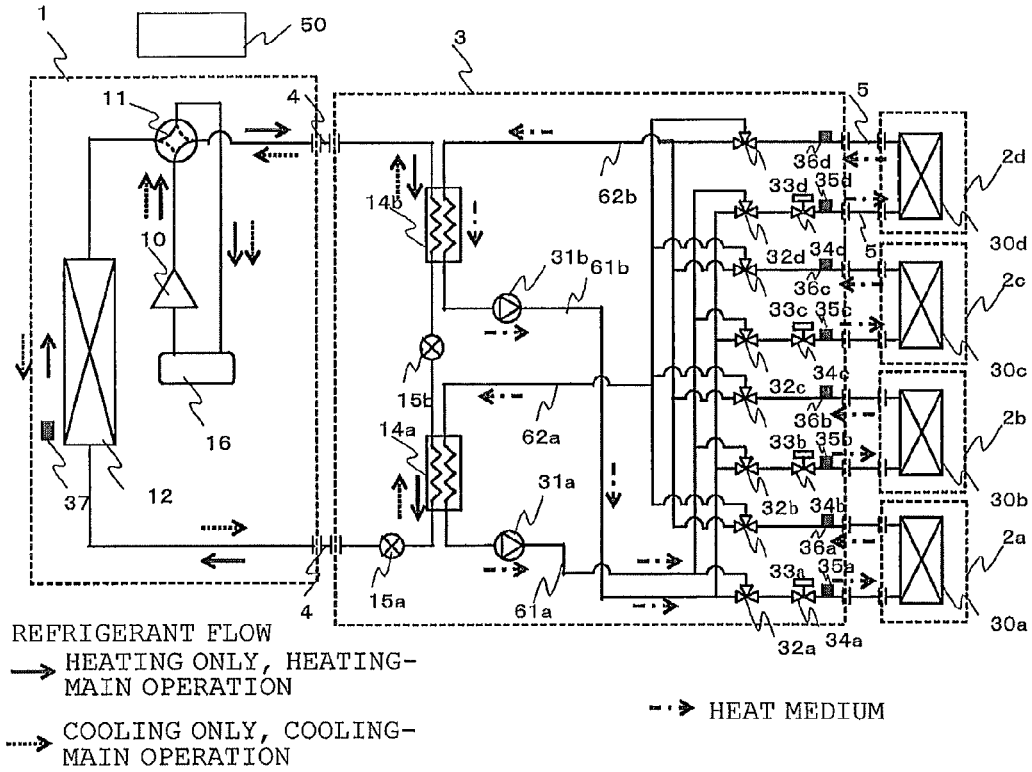
FIG. 1 is a system circuit diagram of an air conditioning apparatus according to Embodiment 1 of the present invention.

FIG. 1 is a system circuit diagram of an air conditioning apparatus according to Embodiment 1 of the present invention. In the air conditioning apparatus according to Embodiment 1, a refrigerating cycle circuit is formed by connecting a compressor 10, a four-way valve 11, which is a refrigerant flow path switching device, a heat source-side heat exchanger 12, inter-heat-medium heat exchangers 14*a* and 14*b*, expansion devices 15*a* and 15*b*, such as electronic expansion valves, and an accumulator 16 with piping. A refrigerant circulates in the refrigerating cycle circuit. The inter-heat-medium heat exchanger 14*a* is equivalent to a first inter-heat-medium heat exchanger. The inter-heat-medium heat exchanger 14*b* is equivalent to a second inter-heat-medium heat exchanger. The expansion device 15*a* and expansion device 15*b* are respectively equivalent to a first expansion device and a second expansion device.

A heat medium circulating circuit, in which a heat medium circulates, is formed between a heat medium converter 3 and use-side heat exchangers 30*a*, 30*b*, 30*c*, and 30*d*. The refrigerant circulating in the refrigerating cycle circuit and the heat medium circulating in the heat medium circulating circuit are subjected to heat exchange in the heat medium converter 3.

The heat medium circulating circuit is formed by connecting the inter-heat-medium heat exchangers 14*a* and 14*b*, the use-side heat exchangers 30*a*, 30*b*, 30*c*, and 30*d*, pumps 31*a* and 31*b*, which are heat medium feeding units, heat medium flow path switching devices 32*a*, 32*b*, 32*c*, 32*d*, 33*a*, 33*b*, 33*c*, and 33*d*, and heat medium flow rate adjusting devices 34*a*, 34*b*, 34*c*, and 34*d* with piping. The pump 31*a* is equivalent to a first heat medium feeding unit. The pump 31*b* is equivalent to a second heat medium feeding unit. The heat medium flow path switching devices 32*a*, 32*b*, 32*c*, and 32*d* are equivalent to first heat medium flow path switching devices. The heat medium flow path switching devices 33*a*, 33*b*, 33*c*, and 33*d* are equivalent to second heat medium flow path switching devices. The heat medium flow rate adjusting devices 34*a*, 34*b*, 34*c*, and 34*d* are equivalent to heat medium flow rate adjusting parts. Although, in Embodiment 1, the number of indoor units 2 (use-side heat exchangers 30) is four (indoor units 2*a*, 2*b*, 2*c*, and 2*d*), this is not a limitation; any number of indoor units 2 (use-side heat exchangers 30) may be used.

In Embodiment 1, the compressor 10, the four-way valve 11, the heat source-side heat exchanger 12, the accumulator 16, and outside air temperature detecting means 37 are included in a heat source unit 1 (outdoor unit). A controller 50, which controls the entire air conditioning apparatus, is also included in the heat source unit 1. The use-side heat exchangers 30*a*, 30*b*, 30*c*, and 30*d* are respectively included in the indoor units 2*a*, 2*b*, 2*c*, and 2*d*. The inter-heat-medium heat exchangers 14*a* and 14*b* and the expansion devices 15*a* and 15*b* are included in the heat medium converter 3 (branching unit), which also functions as a heat medium branching unit. The heat medium flow path switching devices 32*a*, 32*b*, 32*c*, 32*d*, 33*a*, 33*b*, 33*c*, and 33*d*, the heat medium flow rate adjusting devices 34*a*, 34*b*, 34*c*, and 34*d*, and heat medium temperature detecting means 35*a*, 35*b*, 35*c*, 35*d*, 36*a*, 36*b*, 36*c*, and 36*d* are also included in the heat medium converter 3.

The heat source unit 1 and the heat medium converter 3 are connected with refrigerant pipes 4. The heat medium converter 3 and each of the indoor units 2*a*, 2*b*, 2*c*, and 2*d* (each of the use-side heat exchangers 30*a*, 30*b*, 30*c*, and 30*d*) are connected with heat medium pipes 5, in which a safety heat medium such as water or an antifreeze liquid flows. That is, the heat medium converter 3 and each of the indoor units 2*a*, 2*b*, 2*c*, and 2*d* (each of the use-side heat exchangers 30*a*, 30*b*, 30*c*, and 30*d*) are connected by a single heat medium path.

The compressor 10 compresses a drawn refrigerant and discharges (supplies) the compressed refrigerant. The four-way valve 11, which functions as a flow path switching device, performs valve switching according to a operation mode related to cooling or heating, in response to a command from the controller 50, so that the circulating circuit of the refrigerant is switched. In Embodiment 1, the following four operation modes are provided, according to each of which, the circulating circuit of the refrigerant is switched.

1. Cooling only operation (operation in which all indoor units 2 in operation are performing cooling (including dehumidification; this also applies to the following description))
2. Cooling-main operation (operation in which cooling is dominant when indoor units 2 that are performing cooling and indoor units 2 that are performing heating are present at the same time)
3. Heating only operation (operation in which all indoor units 2 in operation are performing heating)
4. Cooling-main operation (operation in which heating is dominant when indoor units 2 that are performing cooling and indoor units 2 that are performing heating are present at the same time)

The heat source-side heat exchanger 12 has fins (not shown) to expand heat transfer areas between a heat transfer pipe, through which the refrigerant passes, and the refrigerant passing through the heat transfer pipe and between the heat transfer pipe and the outside air, for example; the heat source-side heat exchanger 12 exchanges heat between the refrigerant and the outside air. In heating only operation or heating-main operation, for example, the heat source-side heat exchanger 12 functions as an evaporator to evaporate the refrigerant for gasification (vaporization). In cooling only operation or cooling-main operation, the heat source-side heat exchanger 12 functions as a condenser or gas cooler (the term condenser will be used in the following description). In some cases, the refrigerant may be placed in a state in which two phases of a gas and a liquid are mixed (gas-liquid two-phase refrigerant) without being completely gasified or liquefied.

The inter-heat-medium heat exchangers 14*a* and 14*b* each have a heat transfer part, through which the refrigerant passes, and a heat transfer part, through which the heat medium passes, so that heat is exchanged between the refrigerant and heat medium. In Embodiment 1, the inter-heat-medium heat exchanger 14*a* functions as an evaporator in cooling only operation and heating-main operation and also functions as a condenser in heating only operation and cooling-main operation. The inter-heat-medium heat exchanger 14*a* functions as an evaporator in cooling only operation and cooling-main operation to cool the heat medium by having the refrigerant absorb the refrigerant. In heating only operation and heating-main operation, the inter-heat-medium heat exchanger 14*a* functions as a condenser to heat the heat medium by having the refrigerant dissipate heat. For example, the expansion devices 15*a* and 15*b*, such as electronic expansion valves, reduce the pressure of the refrigerant by adjusting the refrigerant flow rate. The accumulator 16 has a function of storing an excess refrigerant present in the refrigerating cycle circuit and preventing much refrigerant liquid from returning to the compressor 10, which would otherwise damage the compressor 10.

The pumps 31*a* and 31*b*, which are heat medium feeding units, pressurize the heat medium to circulate it. An amount by which the heat medium is fed (an amount of discharge) by the pumps 31*a* and 31*b* can be changed by changing the rotation speed of built-in motors (not shown) within a fixed range. The use-side heat exchangers 30*a*, 30*b*, 30*c*, and 30*d* heat or cool the air in air conditioning space by, in their respective indoor units 2*a*, 2*b*, 2*c*, and 2*d*, exchanging heat between the heat medium and the air in the air conditioning space.

The heat medium flow path switching devices 32*a*, 32*b*, 32*c*, and 32*d*, which are three-way switching valves or the like, for example, are respectively connected with piping to the heat medium inlets of the use-side heat exchangers 30*a*, 30*b*, 30*c*, and 30*d*, and the flow paths are switched on the inlet side of the use-side heat exchangers 30*a*, 30*b*, 30*c*, and 30*d* (on the heat medium inlet side). The heat medium flow path switching devices 33*a*, 33*b*, 33*c*, and 33*d*, which are three-way switching valves or the like, for example, are respectively connected with piping to the heat medium outlets of the use-side heat exchangers 30*a*, 30*b*, 30*c*, and 30*d*, and the flow paths are switched on the outlet side of the use-side heat exchangers 30*a*, 30*b*, 30*c*, and 30*d* (on the heat medium output side). These switching devices perform switching to circulate, in the use-side heat exchangers 30*a*, 30*b*, 30*c*, and 30*d*, one of the heat media that have been heated or cooled in the inter-heat-medium heat exchangers 14*a* and 14*b*.

Furthermore, the heat medium flow rate adjusting devices 34*a*, 34*b*, 34*c*, and 34*d*, which are two-way flow rate adjusting valves, respectively adjust the flow rates of the heat medium entering the use-side heat exchangers 30*a*, 30*b*, 30*c*, and 30*d*.

<Operation Modes>

Next, the operation of the air conditioning apparatus in each operation mode will be described on the basis of the flows of the refrigerant and heat medium. The level of the pressure in the refrigerating cycle circuit and the like is not determined by a relationship with the reference pressure, but is represented as a relative pressure developed due to compression performed by the compressor 10, refrigerant flow rate control performed by, for example, the expansion devices 15*a* and 15*b*, or the like. This is also true for the level of temperature.

(Cooling Only Operation)

First, the refrigerant flow in the refrigerating cycle circuit will be described. In the heat source unit 1, the refrigerant sucked in by the compressor 10 is compressed and is discharged as a high-pressure gas refrigerant. The refrigerant discharged from the compressor 10 passes through the four-way valve 11 and enters the heat source-side heat exchanger 12, which functions as a condenser. While passing through the heat source-side heat exchanger 12, the high-pressure gas refrigerant is subjected to heat exchange with the outside air and condenses, after which the refrigerant exits as a high-pressure liquid refrigerant, passes through the refrigerant pipe 4, and enters the heat medium converter 3.

When the opening-degree of the expansion device 15*a* is adjusted, the refrigerant that has entered the heat-medium converter 3 is expanded and enters the inter-heat-medium heat exchanger 14*a* as a gas-liquid two-phase refrigerant at low temperature and low pressure. Since the inter-heat-medium heat exchanger 14*a* functions as an evaporator for the refrigerant, the refrigerant passing through the inter-heat-medium heat exchanger 14*a* cools the heat medium that is a target to be subjected to heat exchange (absorbs heat from the heat medium). That is, the refrigerant passing through the inter-heat-medium heat exchanger 14*a* cools the heat medium circulating in the heat medium circulating circuit. The refrigerant is not completely vaporized in the inter-heat-medium heat exchanger 14*a*, and exits still as the gas-liquid two-phase refrigerant. At that time, the expansion device 15*b* is left fully open to prevent a pressure loss.

The gas-liquid two-phase refrigerant at low temperature and low pressure further enters the inter-heat-medium heat exchanger 14*b*. The inter-heat-medium heat exchanger 14*b* also functions as an evaporator, so the refrigerant that has entered the inter-heat-medium heat exchanger 14*b* cools the heat medium, as described above, and exits as a gas refrigerant. The gas refrigerant that has exited the inter-heat-medium heat exchanger 14*b* passes through the refrigerant pipe 4, exits the heat medium converter 3, and enters the heat source unit 1.

The refrigerant that has entered the heat source unit 1 passes through the four-way valve 11 and accumulator 16, and is then sucked into the compressor 10 again.

Next, the heat medium flow in the heat medium circulating circuit will be described. The heat medium is subjected to heat exchange with the refrigerant in the inter-heat-medium heat exchangers 14*a* and 14*b* and is cooled. The heat medium cooled in the inter-heat-medium heat exchanger 14*a* is sucked in by the pump 31*a* and fed to a first heat medium feeding pipe 61*a*. The heat medium cooled in the inter-heat-medium heat exchanger 14*b* is sucked in by the pump 31*b* and fed to a second heat medium feeding pipe 61*b*.

The flow paths of the heat media in the first heat medium flow path 61*a* and second heat medium flow path 61*b* are switched by the heat medium flow path switching devices 32*a*, 32*b*, 32*c*, and 32*d*, and the heating media enter the use-side heat exchangers 30*a*, 30*b*, 30*c*, and 30*d*. In this case, the flow paths are switched so that the cooling only capacity of the indoor units cooled by the heat medium in the first heat medium feeding pipe 61*a* and the cooling only capacity of the indoor units cooled by the heat medium in the second heat medium feeding pipe 61*b* each account for about half of the cooling only capacity of all the indoor units. The cooling capacities of the indoor units 2*a*, 2*b*, 2*c*, and 2*d* can be determined by, for example, the controller 50, and the flow paths of the heat medium flow path switching devices 32*a*, 32*b*, 32*c*, and 32*d* are switched on the basis of the cooling capacities. Here, the heat medium flow path switching devices 32*a*, 32*b*, 32*c*, and 32*d* are switched so that the heat medium in the first heat medium feeding pipe 61*a* enters the use-side heat exchangers 30*a* and 30*b* and the heat medium in the second heat medium feeding pipe 61*b* enters the use-side heat exchangers 30*c* and 30*d*, for example.

The flow rates of the heat media that have passed through the heat medium flow path switching devices 32*a*, 32*b*, 32*c*, and 32*d* are adjusted by the heat medium flow rate adjusting devices 34*a*, 34*b*, 34*c*, and 34*d*, after which they enter their corresponding use-side heat exchangers 30*a*, 30*b*, 30*c*, and 30*d*. To stop any one of the indoor units 2 (2*a*, 2*b*, 2*c*, and 2*d*), the heat medium flow rate adjusting device 34 (34*a*, 34*b*, 34*c*, or 34*d*) corresponding to the indoor unit 2 to be stopped is fully closed. The heat media that have passed through the use-side heat exchangers 30*a*, 30*b*, 30*c*, and 30*d* then pass through the heat medium flow path switching devices 33*a*, 33*b*, 33*c*, and 33*d*. In this case, the heat medium flow path switching devices 33*a*, 33*b*, 33*c*, and 33*d* are switched so that the heat medium that has exited the first heat medium feeding pipe 61*a* returns to the first heat medium return pipe 62*a*. Similarly, the heat medium flow path switching devices 33*a*, 33*b*, 330, and 33*d* are switched so that the heat medium that has exited the second heat medium feeding pipe 61*b* returns to the second heat medium return pipe 62*b*.

(Heating Only Operation)

First, the refrigerant flow in the refrigerating cycle circuit will be described. In the heat source unit 1, the refrigerant sucked in by the compressor 10 is compressed and is discharged as a high-pressure gas refrigerant. The refrigerant discharged from the compressor 10 passes through the four-way valve 11, further passes through the refrigerant pipe 4, and enters the heat medium converter 3.

The gas refrigerant that has entered the heat medium converter 3 enters the inter-heat-medium heat exchanger 14*b*. Since the inter-heat-medium heat exchanger 14*b* functions as a condenser for the refrigerant, the refrigerant passing through the inter-heat-medium heat exchanger 14*b* cools the heat medium that is a target to be subjected to heat exchange (dissipates heat to the heat medium). The refrigerant is not completely liquefied in the inter-heat-medium heat exchanger 14*b* and exits as a gas-liquid two-phase refrigerant at high temperature and high pressure.

The gas-liquid two-phase refrigerant at high temperature and high pressure further enters the inter-heat-medium heat exchanger 14*a*. At that time, the expansion device 15*b* is left fully open to prevent a pressure loss. The refrigerant that has entered the inter-heat-medium heat exchanger 14*a* heats the heat medium as described above and exits the inter-heat-medium heat exchanger 14*a* as a liquid refrigerant. The pressure of the liquid refrigerant that has exited is reduced by the expansion device 15*a*, and the refrigerant becomes a gas-liquid two-phase refrigerant at low temperature and low pressure. The gas-liquid two-phase refrigerant at low temperature and low pressure passes through the refrigerant pipe 4, exits the heat medium converter 3, and enters the heat source unit 1.

The refrigerant that has entered the heat source unit 1 enters the heat source-side heat exchanger 12, evaporates by being subjected to heat exchange with the air, and exits as a gas refrigerant or gas-liquid two-phase refrigerant. The refrigerant that has been subjected to evaporation passes through the four-way valve 11 and accumulator 16, and is then sucked into the compressor 10 again.

Next, the heat medium flow in the heat medium circulating circuit will be described. The heat media are subjected to heat exchange with the refrigerants in the inter-heat-medium heat exchangers 14*a* and 14*b* and are heated. The heat medium heated in the inter-heat-medium heat exchanger 14*a* is sucked in by the pump 31*a* and fed to the first heat medium feeding pipe 61*a*. The heat medium heated in the inter-heat-medium heat exchanger 14*b* is sucked in by the pump 31*b* and fed to the second heat medium feeding pipe 61*b*.

The flow paths of the heat media in the first heat medium feeding pipe 61*a* and second heat medium feeding pipe 61*b* are switched by the heat medium flow path switching devices 32*a*, 32*b*, 32*c*, and 32*d*, and the heating media enter the use-side heat exchangers 30*a*, 30*b*, 30*c*, and 30*d*. In this case, the flow paths are switched so that the heating only capacity of the indoor units heated by the heat medium in the first heat medium feeding pipe 61*a* and the heating only capacity of the indoor units heated by the heat medium in the second heat medium feeding pipe 61*b* each account for about half of the heating only capacity of all the indoor units 2*a*, 2*b*, 2*c*, and 2*d*. The heating capacity of the indoor units 2*a*, 2*b*, 2*c*, and 2*d* can be determined by, for example, the controller 50, and the flow paths of the heat medium flow path switching devices 32*a*, 32*b*, 32*c*, and 32*d* are switched on the basis of the cooling capacities. Here, the heat medium flow path switching devices 32*a*, 32*b*, 32*c*, and 32*d* are switched so that the heat medium in the first heat medium feeding pipe 61*a* enters the use-side heat exchangers 30*a* and 30*b* and the heat medium in the second heat medium feeding pipe 61 b enters the use-side heat exchangers 30*c* and 30*d*, for example.

The flow rates at which the heat media that have passed through the heat medium flow path switching devices 32*a*, 32*b*, 32*c*, and 32*d* enter their corresponding use-side heat exchangers 30*a*, 30*b*, 30*c*, and 30*d* are adjusted by the heat medium flow rate adjusting devices 34*a*, 34*b*, 34*c*, and 34*d*. To stop any one of the indoor units 2, the pertinent heat medium flow rate adjusting device 34 is fully closed. The heat media then pass through the heat medium flow path switching devices 33*a*, 33*b*, 33*c*, and 33*d*. In this case, the heat medium flow path switching devices 33*a*, 33*b*, 33*c*, and 33*d* are switched so that the heat medium that has exited the first heat medium feeding pipe 61 a returns to the first heat medium return pipe 62*a* and the heat medium that has exited the second heat medium feeding pipe 61*b* returns to the second heat medium return pipe 62*b*.

(Cooling-Main operation)

The refrigerant flow in the refrigerating cycle circuit in cooling-main operation will be described below. First, a difference from cooling only operation will be outlined. In cooling only operation, the expansion device 15*a* has functioned as an expansion valve and the expansion device 15*b* has been fully opened; in cooling-main operation, conversely, the expansion device 15*a* is fully opened and the expansion device 15*b* functions as an expansion valve. Then, in cooling-main operation, the inter-heat-medium heat exchanger 14*a* functions as a condenser and the inter-heat-medium heat exchanger 14*b* functions as an evaporator; by comparison, in cooling only operation, both the inter-heat-medium heat exchangers 14*a* and 14*b* have functioned as an evaporator. Since one of the inter-heat-medium heat exchangers 14*a* and 14*b* functions as a condenser and the other functions as an evaporator in this way, simultaneous operation of cooling and heating can be achieved.

In the heat source unit 1, the refrigerant sucked in by the compressor 10 is compressed and is discharged as a high-pressure gas refrigerant. The refrigerant discharged from the compressor 10 passes through the four-way valve 11 and enters the heat source-side heat exchanger 12, which functions as a condenser. While passing through the heat source-side heat exchanger 12, the high-pressure gas refrigerant is subjected to heat exchange with the outside air and condenses. However, the refrigerant is not completely liquefied and exits as a gas-liquid two-phase refrigerant at high pressure, after which the refrigerant passes through the refrigerant pipe 4 and enters the heat medium converter 3.

The refrigerant that has entered the heat medium converter 3 enters the inter-heat-medium heat exchanger 14*a*. At that time, the expansion device 15*a* is left fully open to prevent a pressure loss. Although, in cooling only operation, the inter-heat-medium heat exchanger 14*a* has functioned as an evaporator for the refrigerant, it functions as a condenser for the refrigerant in cooling-main operation. Therefore, the refrigerant passing through the inter-heat-medium heat exchanger 14*a* heats the heat medium that is a target to be subjected to heat exchange, and is liquefied (dissipates heat to the heat medium).

The pressure of the liquefied refrigerant is reduced by the expansion device 15*b*, and the refrigerant becomes a gas-liquid two-phase refrigerant at low temperature and low pressure. The refrigerant at low temperature and low pressure enters the inter-heat-medium heat exchanger 14*b*. Since the inter-heat-medium heat exchanger 14*b* functions as an evaporator for the refrigerant, the refrigerant passing through the inter-heat-medium heat exchanger 14*b* cools the heat medium that is a target to be subjected to heat exchange (absorbs heat from the heat medium). The refrigerant that has exited passes through the refrigerant pipe 4, exits the heat medium converter 3, and enters the heat source unit 1.

The refrigerant that has entered the heat source unit 1 passes through the four-way valve 11 and accumulator 16, and is then sucked into the compressor 10 again.

Next, the heat medium flow in the heat medium circulating circuit will be described. The heat medium is subjected to heat exchange with the refrigerant in the inter-heat-medium heat exchanger 14*a* and is heated. The heat medium heated in the inter-heat-medium heat exchanger 14*a* is sucked in by the pump 31*a* and fed to the first heat medium feeding pipe 61*a*. In the inter-heat-medium heat exchanger 14*b*, the heat medium is subjected to heat exchange with the refrigerant and is cooled. The heat medium cooled in the inter-heat-medium heat exchanger 14*b* is sucked in by the pump 31*b* and fed to the second heat medium flow path 61*b*.

The flow paths of the heat media in the first heat medium feeding pipe 61*a* and in the second heat medium feeding pipe 61*b* are switched by the heat medium flow path switching devices 32*a*, 32*b*, 32*c*, and 32*d*, and the heating media enter the use-side heat exchangers 30*a*, 30*b*, 30*c*, and 30*d*. In this case, the flow paths are switched depending on whether the indoor units 2*a*, 2*b*, 2*c*, and 2*d* are to perform cooling or heating operation. That is, in cooling-main operation, the heat medium is heated because the inter-heat-medium heat exchanger 14*a* functions as a condenser for the refrigerant. Accordingly, the flow paths are switched so that indoor units to be used for heating are connected to the same side as the inter-heat-medium heat exchanger 14*a* to form a heat medium circulating circuit between the indoor units for heating and the inter-heat-medium heat exchanger 14*a*. The inter-heat-medium heat exchanger 14*b* cools the heat medium because it functions as an evaporator for the refrigerant. Accordingly, the flow paths are switched so that indoor units to be used for cooling are connected to the same side as the inter-heat-medium heat exchanger 14 to form a heat medium circulating circuit between the indoor units for cooling and the inter-heat-medium heat exchanger 14*b*.

If, for example, the indoor units 2*a*, 2*b*, and 2*c* are in operation for cooling and the indoor unit 2*d* is in operation for heating, then the heat medium in the first heat medium feeding pipe 61*b* may pass through the heat medium flow path switching devices 32*a*, 32*b*, and 32*c* and the cooled heat medium may enter the use-side heat exchangers 30*a*, 30*b*, and 30*c*. The heat medium in the second heat medium feeding pipe 61*a* may pass through the heat medium flow path switching device 32*d* and the heated heat medium may enter the use-side heat exchanger 30*d*. Whether the indoor units 2*a*, 2*b*, 2*c*, and 2*d* are in operation for cooling or heating can be decided by, for example, the controller 50, and the flow paths of the heat medium flow path switching devices 32*a*, 32*b*, 32*c*, and 32*d* are switched accordingly.

The flow rates at which the heat media that have passed through the heat medium flow path switching devices 32*a*, 32*b*, 32*c*, and 32*d* enter their corresponding use-side heat exchangers 30*a*, 30*b*, 30*c*, and 30*d* are adjusted by the heat medium flow rate adjusting devices 34*a*, 34*b*, 34*c*, and 34*d*. To stop any one of the indoor units 2, the pertinent heat medium flow rate adjusting device 34 is fully closed. The heat media then pass through the heat medium flow path switching devices 33*a*, 33*b*, 33*c*, and 33*d*. in this case, the heat medium flow path switching devices 33*a*, 33*b*, 33*c*, and 33*d* are switched so that the heat medium that has exited the first heat medium feeding pipe 61*a* returns to the first heat medium return pipe 62*a*. Similarly, the heat medium flow path switching devices 33*a*, 33*b*, 33*c*, and 33*d* are switched so that the heat medium that has exited the second heat medium feeding pipe 61*b* returns to the second heat medium return pipe 62*b*.

(Heating-Main Operation)

The refrigerant flow in the refrigerating cycle circuit in heating-main operation will be described below. First, a difference from heating only operation will be outlined. In heating only operation, the expansion device 15*a* has functioned as an expansion valve and the expansion device 15*b* has been fully opened; in heating-main operation, conversely, the expansion device 15*a* is fully opened and the expansion device 15*b* functions as an expansion valve. Then, in heating-main operation, the inter-heat-medium heat exchanger 14*a* functions as an evaporator and the inter-heat-medium heat exchanger 14*b* functions as a condenser; by comparison, in heating only operation, both the inter-heat-medium heat exchangers 14*a* and 14*b* have functioned as a condenser.

In the heat source unit 1, the refrigerant sucked in by the compressor 10 is compressed and is discharged as a high-pressure gas refrigerant. The refrigerant discharged from the compressor 10 passes through the four-way valve 11, further passes through the refrigerant pipe 4, and enters the heat medium converter 3.

The gas refrigerant that has entered the heat medium converter 3 enters the inter-heat-medium heat exchanger 14*b*. Since the inter-heat-medium heat exchanger 14*b* functions as a condenser for the refrigerant, the refrigerant passing through the inter-heat-medium exchanger 14*b* heats the heat medium that is a target to be subjected to heat exchange, and is liquefied (dissipates heat to the heat medium).

The high-pressure liquid refrigerant is made to be a gas-liquid two-phase refrigerant at low temperature and low pressure by the expansion device 15*b*, and then enters the inter-heat-medium heat exchanger 14*a*. Since the inter-heat-medium heat exchanger 14*a* functions as an evaporator for the refrigerant, the refrigerant passing through the inter-heat-medium heat exchanger 14*a* cools the heat medium that is a target to be subjected to heat exchange, and evaporates (absorbs heat from the heat medium). At that time, the expansion device 15*a* is left fully open to prevent a pressure loss. The gas refrigerant or gas-liquid two-phase refrigerant that has exited passes through the refrigerant pipe 4, exits the heat medium converter 3, and enters the heat source unit 1.

The refrigerant that has entered the heat source unit 1 enters the heat source-side heat exchanger 12 in which the refrigerant is subjected to heat exchange with the air and evaporates, after which the refrigerant exits as a gas refrigerant or gas-liquid two-phase refrigerant. The refrigerant that has evaporated passes through the four-way valve 11 and accumulator 16, and is then sucked into the compressor 10 again.

Next, the heat medium flow in the heat medium circulating circuit will be described. The heat medium is subjected to heat exchange with the refrigerant in the inter-heat-medium heat exchanger 14*a* and is cooled. The heat medium cooled in the inter-heat-medium heat exchanger 14*a* is sucked in by the pump 31*a* and fed to the first heat medium feeding pipe 61*a*. In the inter-heat-medium heat exchanger 14*b*, the heat medium is subjected to heat exchange with the refrigerant and is heated. The heat medium heated in the inter-heat-medium heat exchanger 14*b* is sucked in by the pump 31*b* and fed to the second heat medium flow path 61*b*.

The heat medium flow path switching devices 32 and 33 and the heat medium flow rate adjusting devices 34 work as in cooling-main operation described above, As described above for cooling-main operation and heating-main operation, the air conditioning apparatus in this embodiment enables simultaneous operation of cooling and heating by having one of the inter-heat-medium heat exchangers 14*a* and 14*b* function as a condenser and having the other function as an evaporator.

<Heat Medium Preheating Method>

Next, preheating will be described, which is performed to prevent the outlet air temperature from being lowered when heating is started in a state in which some indoor units 2 are stopping.

As described above, the heat source unit 1 according to Embodiment 1 circulates heat media between the heat medium converter 3 and use-side heat exchangers 30. As for a multi-system air conditioner intended for a building, some heat medium pipes 5, which connect the heat medium converter 3 and use-side heat exchangers, may be, for example, measure about 50 meters long in one way, so a large amount of heat medium is staying. While the air conditioning apparatus is stopping at night in winter, for example, the heat media staying in the heat medium pipes 5 and use-side heat exchangers 30 dissipate heat. Accordingly, it takes time for the indoor units 2 to start heating, and the outlet air temperature at the start of heating is lowered; the user thereby will lose comfort.

Preheating of the heat medium may be carried out before the indoor units 2 start heating. If all the heat medium pipes 5 and all the use-side heat exchangers 30 are preheated, however, energy required for the preheating becomes too much. Alternatively, preheated indoor units 2 may not be operated on that day or may be intended for cooling, further wasting energy.

In view of the above situation, the air conditioning apparatus according to Embodiment 1 suppresses a drop of the outlet air temperature when some indoor units 2 start heating, by a method described below. Specifically, when the outside air temperature is lower than a certain temperature in winter, about half of all the indoor units 2 are operated for heating before heating starts. Then, about half of all the heat medium pipes 5 can be preheated, suppressing a drop of the temperature of the outlet air from the indoor units 2.

Figure 2:
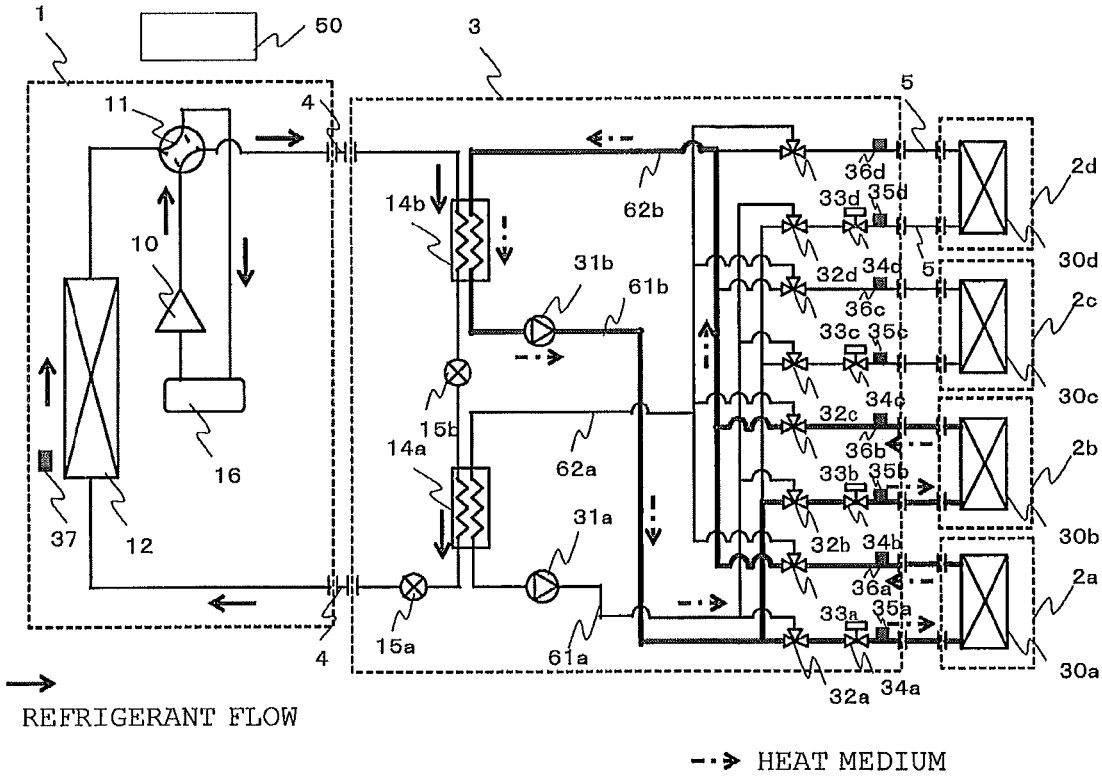
FIG. 2 is a system circuit diagram when the air conditioning apparatus according to Embodiment 1 of the present invention performs preheating.

FIG. 2 is a circuit diagram illustrating an example of preheating operation of Embodiment 1. Half of all the use-side heat exchangers 30 (indoor units 2) are selected in advance that performs preheating operation, having a longer heat medium pipe 5 in order. This is because the length of the heat medium pipe 5 varies depending on the place where the indoor unit 2 is installed and the longer heat medium pipe 5 can store much more preheated heat medium. If an odd number of use-side heat exchangers, five use-side heat exchangers for example, are connected to the air conditioning apparatus, three use-side heat exchangers perform preheating operation. Information on which use-side heat exchanger (indoor units 2) is selected is stored in the controller 50.

Figure 3:
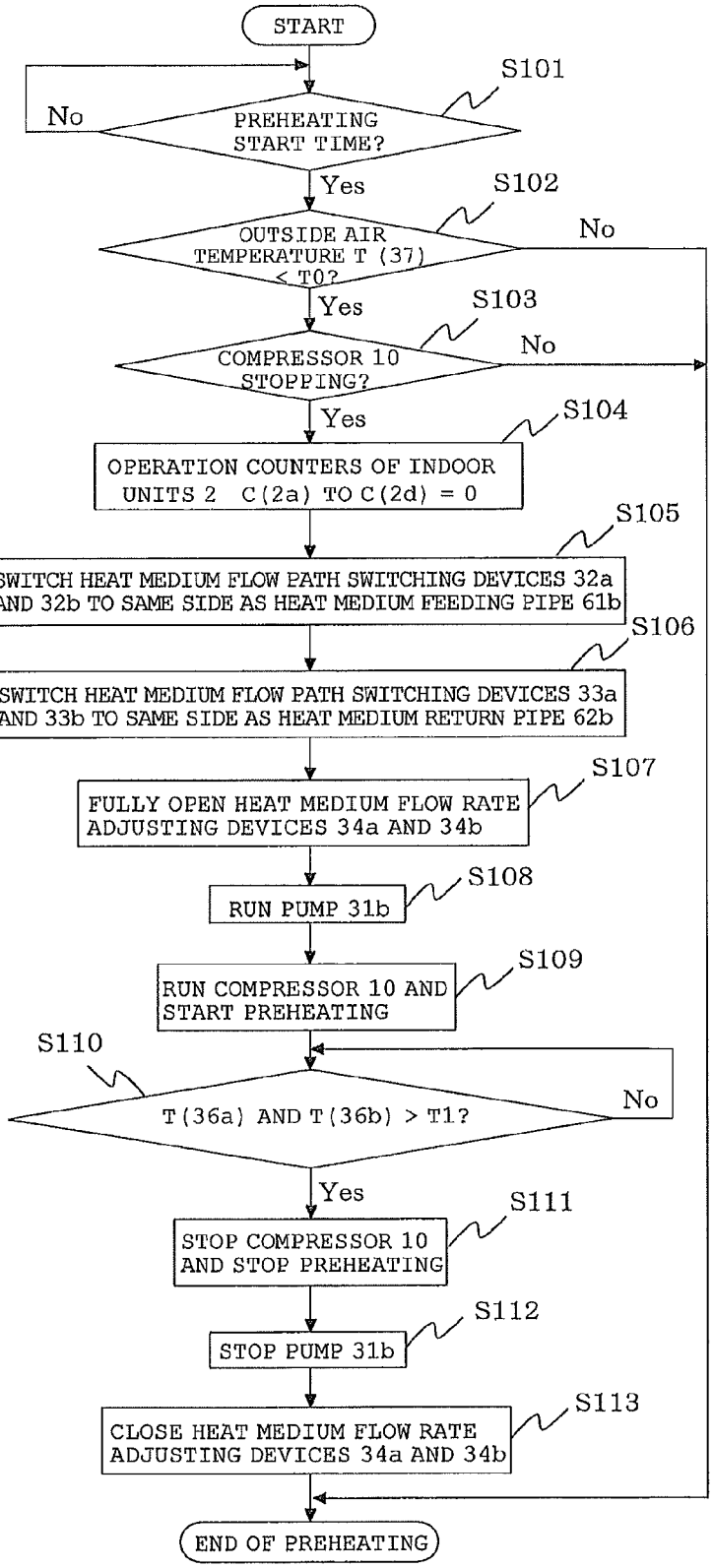
FIG. 3 is a flowchart illustrating an exemplary method of preheating by the air conditioning apparatus according to Embodiment 1 of the present invention.

FIG. 3 is a flowchart illustrating an exemplary method of preheating in Embodiment 1 of the present invention. In the following description, the use-side heat exchangers 30*a* and 30*b* are used for preheating.

When a preheating start time comes (step S101), the controller 50 determines whether to actually start preheating (S102 and S103). The preheating start time is set in advance; for example, it is a time of day in the morning before heating is to be started. For an air conditioning apparatus, such as, for example, a multi-system air conditioner intended for a building, the indoor units 2 are often started to operate at a fixed time of day everyday, so the preheating start time can be roughly determined. Alternatively, the user may specify the preheating start time by using a control unit (not shown) such as a remote controller connected to the indoor units 2.

In step S102, it is determined whether temperature T (37) detected by the outside air temperature detecting means 37 is lower than T0. T0 is 10 degrees C., for example. If the temperature T (37) is lower than T0, then it is determined whether the compressor 10 is stopping (step S103); if the compressor 10 is stopping, preheating is started. If the temperature T (37) is T0 or higher or if the compressor 10 is already in operation, preheating is not performed.

In preheating, the operation counter of each indoor unit 2 is first reset to 0 (step S104). The operation counter is set to 1 when the indoor unit 2 starts heating or cooling.

After that, a heat refrigerant circulating circuit, in which to circulate a heat medium, is formed between the inter-heat-medium heat exchanger 14*b* and the use-side heat exchangers 30*a* and 30*b* to be used for preheating. That is, the heat medium flow path switching devices 32*a* and 32*b* are switched to the same side as the heat medium feeding pipe 61*b* (step S105) and the heat medium flow path switching devices 33*a* and 33*b* are switched to the same side as the heat medium return pipe 62*b* (step S106). In this case, the number of use-side heat exchangers 30 used for preheating is about half of all the use-side heat exchangers 30, as described above.

Then, the heat medium flow rate adjusting devices 34*a* and 34*b* are fully opened (step 8107), the pump 31*b* is operated (step S108), and the heat media staying in the use-side heat exchangers 30*a* and 30*b* and heat medium pipes 5 are circulated, Then, the compressor 10 is operated to start preheating (S109). Only the inter-heat-medium heat exchanger 14*b* is used to heat the heat medium. The refrigerating cycle circuit is the same as in heating only operation or heating-main operation; in the inter-heat-medium heat exchanger 14*a*, however, the pressure of the refrigerant that enters the inter-heat-medium heat exchanger 14*a* is adjusted with the expansion device 15*b* to prevent the heat medium from being heated. If the heat medium is water, for example, the temperature determined by the pressure of the refrigerant entering the inter-heat-medium heat exchanger 14*a* is preferably 0 degrees C. or higher to prevent the heat medium from freezing.

After preheating has been started, when the temperatures T1 detected by the heat medium temperature detecting means 36*a* and 36*b* becomes higher than T1 (step S110), the compressor 10 is stopped to stop preheating (step S111). Then, the pump 31*b* is stopped (step S112) and the heat medium flow rate adjusting devices 34*a* and 34*b* are closed (step S113) to terminate preheating (step S114).

Here, T1 is assumed to be 40 degrees C., which is the heat medium return temperature of the use-side heat exchanger 30 that is being used for heating. If temperature to which the heat medium is preheated is not higher T1, it can be suppressed to preheat the heat medium more than necessary, saving energy. It is possible to prevent the condensing pressure of the refrigerant from being increased by the high-temperature heat medium at the start of heating.

The fans (not shown) stored in the indoor units 2 are stopping during the preheating described above.

When control described above is carried out, a drop of the outlet air temperature can be prevented when the indoor units 2*a* and 2*b* are started to operate for heating.

Now, a case will be considered in which either or both of the indoor units 2*c* and 2*d* are started to operate for heating before either or both of the indoor units 2*a* and 2*b* are started to operate for heating. The heat media staying in the use-side heat exchangers 30*c* and 30*d* and the heat medium pipes 5 connected to them have not been preheated. In this case, if heat medium are exchanged between a preheated use-side heat exchanger 30 and a non-preheated use-side heat exchanger 30 as described below, the same effect as when preheating has been carried out can be obtained.

Figure 4:
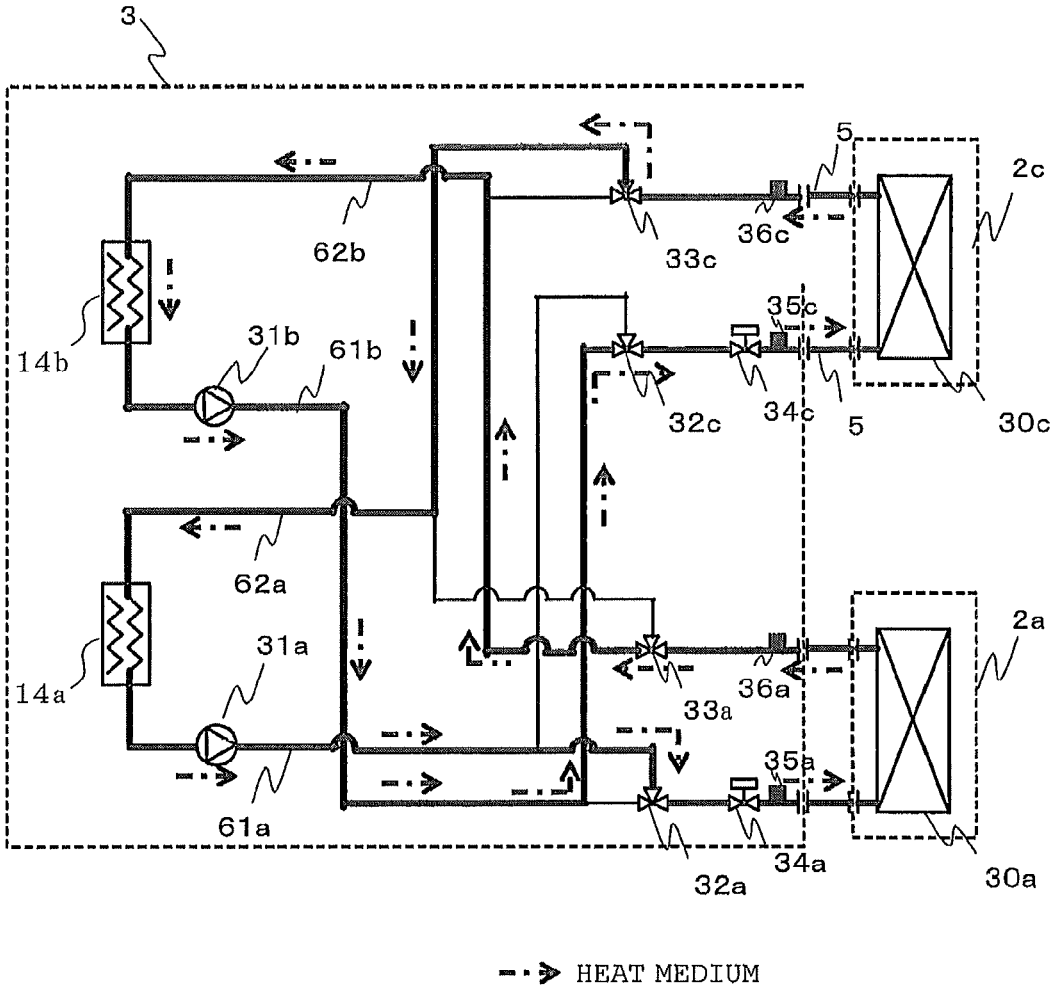
FIG. 4 is a system circuit diagram when heat media are exchanged between use-side heat exchangers of the air conditioning apparatus according to Embodiment 1 of the present invention.
Figure 5:
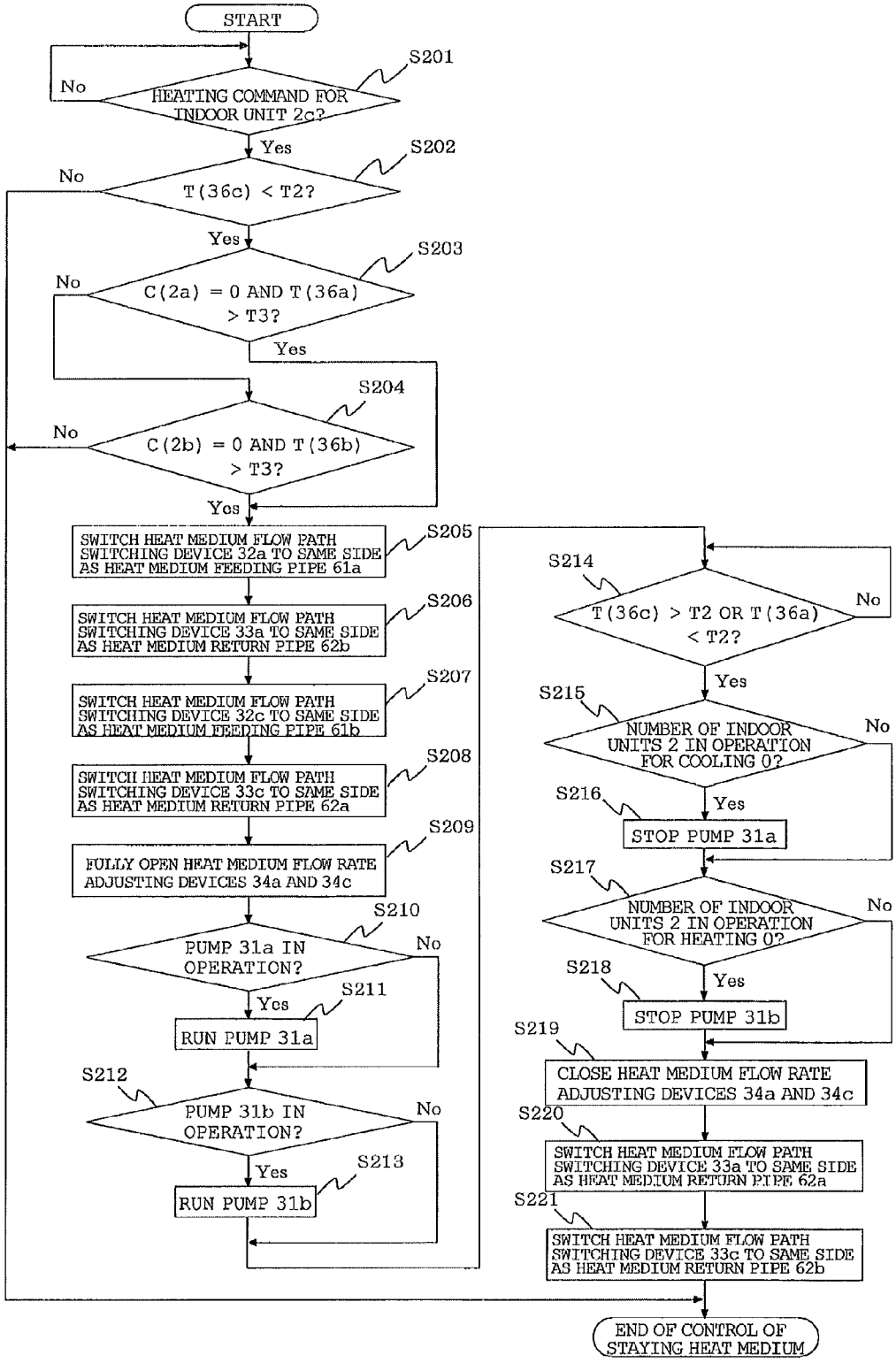
FIG. 5 is a flowchart illustrating an exemplary method of exchanging heat media between use-side heat exchangers of the air conditioning apparatus according to Embodiment 1 of the present invention.

FIG. 4 is a circuit diagram when heat media are exchanged between the use-side heat exchangers 30*a* and 30*c*, and FIG. 5 is a flowchart illustrating an example of control in the exchanging of heat media between use-side heat exchangers 30. A case in which a heating command is issued for the indoor unit 2*c* that is not performing heating operation will be described below as an example.

When a heating command is issued for the indoor unit 2*c* that is not performing heating operation (step S201), the controller 50 determines whether temperature detected by the heat medium temperature detecting means 36*c* is lower than T2 (step S202). If the temperature detected by the heat medium temperature detecting means 36*c* is higher than T2, preheating is decided to be unnecessary and the process is terminated without the heat media being exchanged. Then, the indoor unit 2*c* is started to operate for heating. T2 is 20 degrees C., for example, which is a standard room temperature in heating.

If the temperature detected by the heat medium temperature detecting means 36*c* is lower than T2 (step S202), preheating is decided to be necessary and it is determined whether there are indoor units 2 eligible for heat medium exchange (step S203 and step S204). In step S203, whether heat medium exchange is possible in the indoor unit 2*a* is determined from the operation counter of the indoor unit 2*a* and the temperature detected by the heat medium temperature detecting means 36*a*. In step S204, whether heat medium exchange is possible in the indoor unit 2*b* is determined from the operation counter of the indoor unit 2*b* and the temperature detected by the heat medium temperature detecting means 36*b*. If at least either of the indoor units 2*a* and 2*b* is determined to be eligible for heat medium exchange in step S203 and step S204, the process proceeds to step S205 and subsequent steps to perform heat medium exchange as described later. If none of the indoor units 2*a* and 2*b* satisfy this condition, heat exchange is determined to be not possible, terminating the process for heat medium exchange control.

The judgment as to whether heat medium exchange is possible will be described by using the indoor unit 2*a* as an example. It is determined whether the operation counter of the indoor unit 2*a* in step S203 is 0 and whether the temperature detected by the heat medium temperature detecting means 36*a* is higher than T3. A case in which the operation counter is 0 is equivalent to a case in which the operation counter is reset in step S104 as shown in the flowchart in FIG. 3, that is, a case in which preheating has been carried out. A case in which the operation counter is 1 or more is equivalent to a case in which the indoor unit 2*a* is in operation or is stopping after the operation. If this condition is satisfied, the indoor unit 2*a* is determined to be eligible for heat exchange; if the condition is not satisfied, the indoor unit 2*a* is determined not to be eligible for heat exchange. A judgment is made for the indoor unit 2*b* in the same way (step S204). T3 is 30 degrees C. in consideration of heat dissipation from the heat media, in the use-side heat exchangers 30*a* and 30*b*, which are at 40 degrees C. after preheating. Although, in step S203 and S204, heat medium exchange is determined not to be possible in case of a stop after the operation, heat medium exchange may be made possible in case of a stop after heating.

If step S203 is satisfied (that is, the indoor unit 2*a* is eligible for heat medium exchange), the heat medium flow path switching device 32*a* is switched to the same side as the first heat medium feeding pipe 61*a* (step S205) and the heat medium flow path switching device 33*a* is switched to the same side as the second heat medium return pipe 62*b* (step S206). For the indoor unit 2*c* for which a heating command has been issued, the heat medium flow path switching device 32*c* is switched to the same side as the second heat medium feeding pipe 61*b* (step S207) and the heat medium flow path switching device 33*c* is switched to the same side as the first heat medium return pipe 62*a* (step S208), Then, heat medium circulating circuits are formed as indicated by the bold lines in FIG. 4, in which the heat medium circulates by passing through the inter-heat-medium heat exchanger 14*a*, use-side heat exchanger 30*a*, inter-heat-medium heat exchanger 14*b*, and use-side heat exchanger 30*c* in that order.

The heat medium flow rate adjusting devices 34*a* and 34*c* are then fully opened (step S209), after which if the pumps 31*a* and 31*b* are not in operation (steps S210 and S212), they are operated (steps S211 and S213).

In steps S205 to S213 above, the cold heat medium staying in the use-side heat exchanger 30*c* and its heat medium pipe 5 is discharged toward the heat medium return pipe 62*a* by the heat medium that flows in the second heat medium feeding pipe 61*b*. The preheated heat medium staying in the use-side heat exchanger 30*a* and its heat medium pipe 5 is discharged toward the second heat medium return pipe 62*b* by the heat medium that flows in the first heat medium feeding pipe 61*a*.

If the temperature detected by the heat medium temperature detecting means 36*c* becomes higher than T2 or the temperature detected by the heat medium temperature detecting means 36*a* becomes lower than T2 (step S214), heat medium control is stopped. Step S214 prevents the preheated heat medium and non-preheated heat medium from being mixed together. If any indoor unit 2 is not in operation for cooling at that time (step S215), the pump 31*a* is stopped (step S216). If any indoor unit 2 is not in operation for heating (step S217), the pump 31*b* is stopped (step S218).

Then, the heat medium flow rate adjusting devices 34*a* and 34*c* are closed (step S219), the heat medium flow path switching device 33*a* is switched to the same side as the first heat medium return pipe 62*a* (step S220), and the heat medium flow path switching device 33*c* is switched to the same side as the second heat medium return pipe 62*b* (step S221).

As indicated by the heat medium flows in FIG. 4, the heat media are not directly exchanged between the use-side heat exchangers 30*a* and use-side heat exchanger 30*c*, but the preheated heat media are indirectly exchanged through the heat medium feeding pipes 61*a* and 61*b*. During preheating, however, the heat medium in the heat medium feeding pipe 61*b* has also been preheated, making it possible for the preheated heat medium to enter the use-side heat exchanger 30*c*. Even if the use-side heat exchanger 30*b*, for example, is being used for heating, the above control is possible.

The fans (not shown) stored in the indoor units 2*a* and 2*c* are stopping during heat medium exchange control described above.

Another case will be considered in which the use-side heat exchangers 30*a* and 30*b* are already in operation for heating and the use-side heat exchangers 30*c* and 30*d* cannot undergo the above heat medium exchange control, The use-side heat exchangers 30*c* and 30*d* are assumed to be stopping. To assign half of the heating capacity to each of the inter-heat-medium heat exchangers 14*a* and 14*b*, the use-side heat exchanger 30*a* is connected to the inter-heat-medium heat exchanger 14*a* to form a heat medium circulating circuit and the use-side heat exchanger 30*b* is connected to the inter-heat-medium heat exchanger 14*b* to form another heat medium circulating circuit. If the indoor units 2*c* and 2*d* are started to operate for heating without the heat medium being preheated, it is predicted that the cold heat medium staying in the use-side heat exchanger 30*c* and its heat medium pipe 5 is mixed with the heat medium that is being used for heating and the heat medium temperature drops.

At that time, the heat medium exit temperature of the use-side heat exchangers 30*a* and 30*b* is 40 degrees C., for example. The temperature of the heat media staying in the use-side heat exchangers 30*c* and 30*d* and their heat medium pipes 5 is assumed to be 10 degrees C., for example. When the indoor units 2*c* and 2*d* are started to operate for heating, the controller 50 separately connects the use-side heat exchanger 30*c* to the inter-heat-medium heat exchanger 14*a* and the use-side heat exchanger 30*d* to the inter-heat-medium heat exchanger 14*b*. The preheated heat medium at 40 degrees C. and the heat medium at 10 degrees C. thereby are subjected to heat exchange. If the heat medium pipes 5 of all use-side heat exchangers 30 have the same length, the temperature of the mixed heat medium is 25 degrees C., which is higher than the standard room temperature T2 in heating.

As described above, even when use-side heat exchangers 30 that cannot be controlled for heat medium exchange are started for heating, the temperature of the heat medium can be made higher than the standard room temperature in heating.

As described above, in Embodiment 1, since the heat medium staying in the use-side heat exchanger 30 and its heat medium pipe 5 is preheated in winter (when the outside air temperature is low), it is possible to prevent a drop of the temperature of the outlet air temperature when the indoor unit 2 is started to operate for heating. If half of all use-side heat exchangers 30 and their heat medium pipes 5 are preheated, extra energy consumed for heating can be suppressed.

When the preheated indoor unit 2*a* or indoor unit 2*b* is started to operate for cooling, extra energy may be consumed to cool the heat medium or hot air may be brown from the indoor unit 2*a* or 2*b*. However, the above heat medium exchange control enables the preheated heat medium to be discharged, and the preheated indoor unit 2 can also be thereby started for cooling without extra energy being consumed and without the user losing comfort.

As described above, in Embodiment 1, a heat medium preheating method has been explained for a case in which the temperature of the heat media staying in the use-side heat exchanger 30 and its heat medium pipe 5 is low when the indoor unit 2 is started to operate for heating in winter. Even if the temperature of the heat media staying in the use-side heat exchanger 30 and its heat medium pipe 5 is high when the indoor unit 2 is started to operate for cooling in summer, the heat medium can be precooled in the same way.

In this case, the heat source side remains the same as in cooling only operation, but only the inter-heat-medium heat exchanger 14*b* is used to cool the heat medium. The outside air when precooling is performed is assumed to be at a temperature of 30 degrees C., for example. It is also assumed that when a cooling command is issued for the indoor unit 2*c*, whether to control heat medium exchange with the preheated use-side heat exchangers 30*a* and 30*b* is determined at 25 degrees C., for example, which is the room temperature during cooling. A temperature of 12 degrees C., for example, is sufficient as the temperature of the heat medium after precooling, which is the heat medium return temperature of the use-side heat exchanger 30 during cooling.

Figure 6:
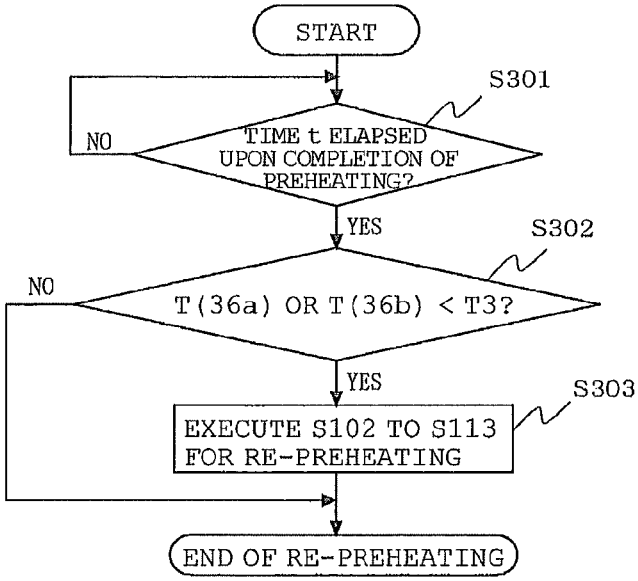
FIG. 6 is a flowchart illustrating an exemplary method of re-preheating by the air conditioning apparatus according to Embodiment 1 of the present invention.

Re-preheating will be now described with reference to FIG. 6, which is carried out when the indoor unit 2 is not started after preheating and the temperature of the heat medium has dropped due to heat dissipation.

If time t has elapsed upon completion of preheating (step S301) and the temperature of the use-side heat exchanger 30*a* or 30*b*, detected by the heat medium temperature detecting means 36*a* or 36*b* is lower than T3 (step S302), steps S102 to S113 are executed as re-preheating (step S303).

Here, t is assumed to be one hour, for example. Re-preheating is carried out only once. For precooling, re-precooling is carried out.

When, in Embodiment 1, the preheating start time comes, the heat medium is automatically preheated or precooled on the basis of the outside air temperature and heat medium temperature. If the air conditioning apparatus in Embodiment 1 is not used for a long period of time (several days), preheating or precooling wastes energy. In view of this, a control unit (not shown) such as a remote controller connected to the indoor units 2 may have a function of canceling preheating or precooling. Then, it becomes possible that the controller 50 prevents preheating or precooling from being carried out when the user cancels preheating or precooling with the remote controller.

Embodiment 2

Figure 7:
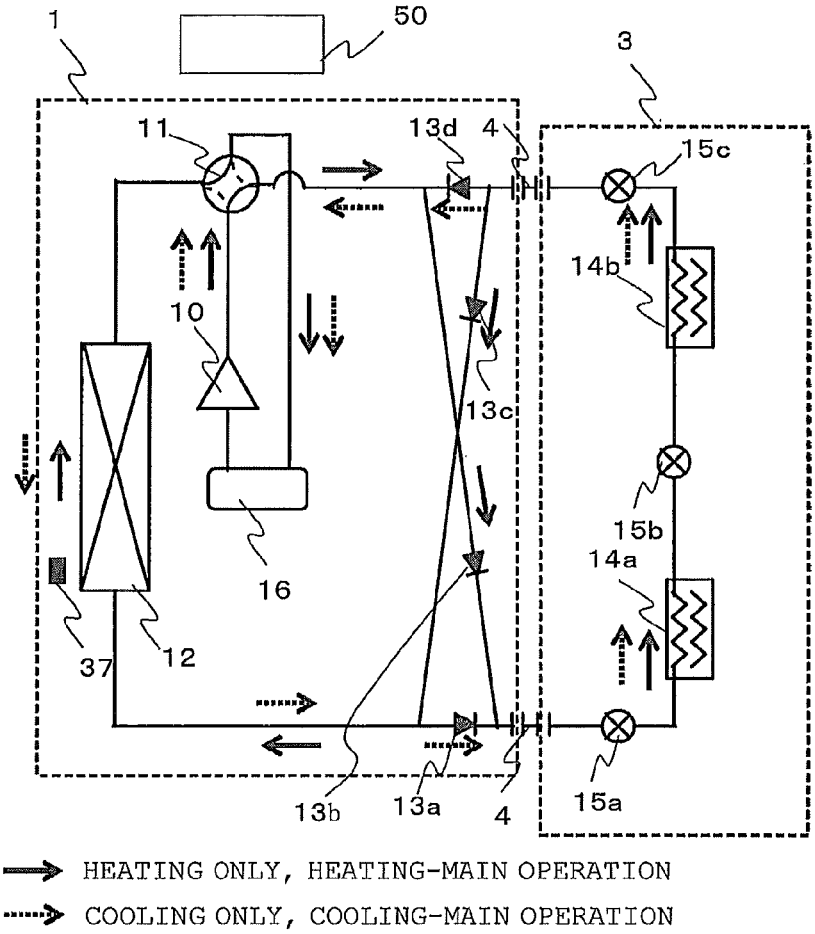
FIG. 7 is a system circuit diagram showing a refrigerant-side circuit of an air conditioning apparatus according to Embodiment 2 of the present invention.

FIG. 7 is a system circuit diagram showing a refrigerant-side circuit of an air conditioning apparatus according to Embodiment 2 of the present invention. In Embodiment 2, check valves 13*a*, 13*b*, 13*c*, and 13*c* are provided on the heat source unit 1; the other structures are the same as in Embodiment 1. The following description focuses on differences between Embodiment 1 and Embodiment 2.

During heating only operation or heating-main operation, the refrigerant that has passed through the four-way valve 11 passes through the check valve 13*b* and enters the heat medium converter 3. During cooling only operation or cooling-main operation, the refrigerant that has exited the heat source-side heat exchanger 12 passes through the check valve 13*a* and enters the heat medium converter 3. The refrigerant that has exited the heat medium converter 3 and returned to the heat source unit 1 passes through the check valve 13*c* and enters the heat source-side heat exchanger 12 during heating only operation or heating-main operation, or passes through the check valve 13*d* and enters the accumulator 16 during cooling only operation or cooling-main cooling.

In the heat medium converter 3, the refrigerant always flows in the fixed direction as shown in FIG. 7, so, in simultaneous operation of cooling and heating, the inter-heat-medium heat exchanger 14*a* functions as a condenser and inter-heat-medium heat exchanger 14*b* functions as an evaporator. Accordingly, although the refrigerant flow direction in the heat source unit 1 differs between heating-main operation and cooling-main operation, the refrigerant flows in the same direction in the heat medium converter 3.

Even if the ratio between heating and cooling by the indoor units 2 changes, the above refrigerant-side circuit enables a switchover between heating-main operation and cooling-main operation while the heat source unit 1 is in operation.

Embodiment 3

Although, in the refrigerant-side circuits in Embodiments 1 and 2 above, the inter-heat-medium heat exchangers 14*a* and 14*b* have been placed so that the refrigerant flows in series on the same side as the heat source unit 1, the placement in Embodiment 3 is such that refrigerants flow in parallel in the two inter-heat-medium heat exchangers 14*a* and 14*b* in heating only operation and cooling only operation. In heating-main operation and cooling-main operation, part of the refrigerant that has exited the heat source unit 1 and entered the heat medium converter 3 flows in the inter-heat-medium heat exchangers 14*a* and 14*b* in series and the remainder flows only one of the inter-heat-medium heat exchangers 14*a* and 14*b*.

Figure 8:
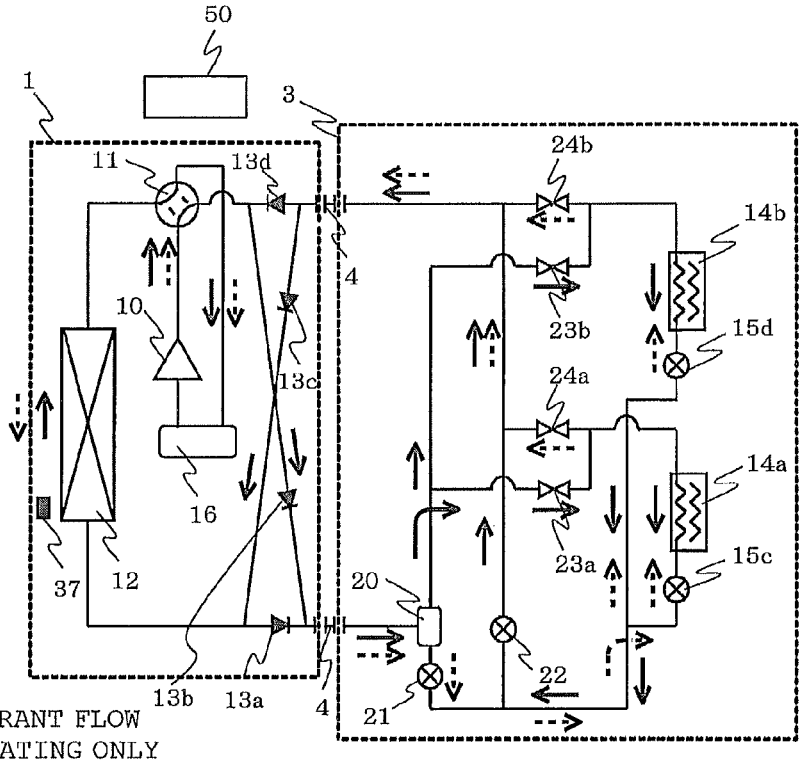
FIG. 8 is a system circuit diagram showing a refrigerant-side circuit of an air conditioning apparatus according to Embodiment 3 of the present invention.
Figure 8:
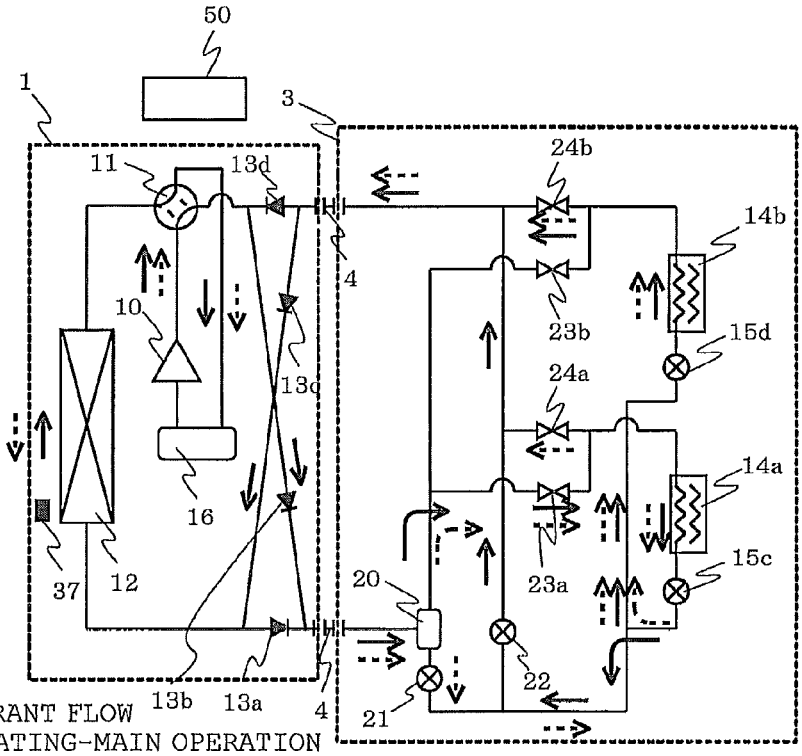

FIG. 8 is a system circuit diagram showing a refrigerant-side circuit of an air conditioning apparatus according to Embodiment 3 of the present invention. The other structures are the same as in Embodiment 1. In FIG. 8(*a*), the solid arrows indicate refrigerant flow directions in heating only operation and the dotted arrows indicate refrigerant flow directions in cooling only operation. In FIG. 8(*b*), the solid arrows indicate refrigerant flow directions in heating-main operation and the dotted arrows indicate refrigerant flow directions in cooling-main operation.

(Heating Only Operation)

First, a refrigerant flow in heating only operation will be described. In the heat source unit 1, the refrigerant sucked In by the compressor 10 is compressed and is discharged as a high-pressure gas refrigerant. The refrigerant discharged from the compressor 10 passes through the four-way valve 11 and check valve 13*b*. The refrigerant further passes through the refrigerant pipe 4 and enters the heat medium converter 3.

The gas refrigerant that has entered the heat medium converter 3 passes through the gas-liquid separator 20 and passes through the switching devices 23*a* and 23*b* so that divided refrigerants flow at substantially the same rate, after which the divided refrigerants enter the inter-heat-medium heat exchangers 14*a* and 14*b*. Since the inter-heat-medium heat exchangers 14*a* and 14*b* function as a condenser for the refrigerant, the refrigerants passing through the inter-heat-medium heat exchangers 14*a* and 14*b* heat the heat media that are targets to be subjected to heat exchange (dissipate heat to the heat media), and exit as liquid refrigerants.

The refrigerant that has exited the inter-heat-medium heat exchanger 14*a* and passed through expansion device 15*c* and the refrigerant that has exited the inter-heat-medium heat exchanger 14*b* and passed through expansion device 15*d* and join together, and the combined refrigerant passes through an expansion device expansion device 22, exits the heat medium converter 3, passes through the refrigerant pipe 4, and enters the heat source unit 1. In this case, the flow rates of the refrigerants are adjusted by controlling the opening-degrees of the expansion devices 15*c*, 15*d*, and 22, and the gas-liquid two-phase refrigerant at low temperature and low pressure is discharged from the heat medium converter 3 to reduce the pressures of the refrigerants.

The refrigerant that has entered the heat source unit 1 passes through the check valve 13*c*, enters the heat source-side heat exchanger 12 in which the refrigerant is subjected to heat exchange with the air and evaporates, after which the refrigerant exits as a gas refrigerant or gas-liquid two-phase refrigerant. The refrigerant that has evaporated passes through the four-way valve 11 and accumulator 16, and is then sucked into the compressor again.

(Heating-Main Operation)

In heating-main operation, the inter-heat-medium heat exchanger 14*a* functions as a condenser and the inter-heat-medium heat exchanger 14*b* functions as an evaporator. As in heading only operation, the refrigerant that has passed through the gas-liquid separator 20 passes through the switching device 23*a* and enters the inter-heat-medium heat exchanger 14*a*. Since the inter-heat-medium heat exchanger 14*a* functions as a condenser for the refrigerant, the refrigerant passing through the inter-heat-medium heat exchanger 14*a* heats the heat medium that is a target to be subjected to heat exchange, and is liquefied (dissipates heat to the heat medium).

The high-pressure liquid refrigerant passes through the expansion device 15*c* and expansion device 15*d* in that order, and enters the inter-heat-medium heat exchanger 14*b* as a gas-liquid two-phase refrigerant at low temperature and low pressure. Since the inter-heat-medium heat exchanger 14*b* functions as an evaporator for the refrigerant, the refrigerant passing through the inter-heat-medium heat exchanger 14*b* cools the heat medium that is a target to be subjected to heat exchange, and is liquefied (absorbs heat from the heat medium). To adjust the flow rate of the refrigerant that enters the inter-heat-medium heat exchanger 14*b*, the expansion device 22 is used to cause part of the refrigerant, the pressure of which has been reduced by the expansion device 15*c*, to bypass the inter-heat-medium heat exchanger 14*b* and enter the heat source unit 1. The opening-degree of the expansion device 21 is set In advance so as to prevent the refrigerant from flowing. The switching devices 23*b* and 24*a* are closed. The refrigerant that has passed through the expansion device 22 and the refrigerant that has passed through the switching device 24*b* join together, and the combined refrigerant passes through the refrigerant pipe 4 and exits the heat medium converter 3.

The refrigerant that has entered the heat source unit 1 enters the heat source-side heat exchanger 12, evaporates by being subjected to heat exchange with the air, and exits as a gas refrigerant or gas-liquid two-phase refrigerant. The refrigerant that has been subjected to evaporation passes through the four-way valve 11 and accumulator 15, and is then sucked into the compressor 10 again.

(Cooling Only Operation)

Next, a refrigerant flow in heating only operation will be described. In the heat source unit 1, the refrigerant sucked in by the compressor 10 is compressed and is discharged as a high-pressure gas refrigerant. The refrigerant discharged from the compressor 10 passes through the four-way valve 11 and enters the heat source-side heat exchanger 12, which functions as a condenser, The high-pressure gas refrigerant condenses in the heat source-side heat exchanger 12 and exits as a high-pressure liquid refrigerant. The refrigerant then passes through the check valve 13*a* and refrigerant pipe 4 and enters the heat medium converter 3.

The refrigerant that has entered the heat medium converter 3 passes through the gas-liquid separator 20. In cooling only operation, the switching devices 23*a* and 23*b* are closed, The liquid refrigerant that has passed through the expansion device 21 is divided into liquid refrigerants with substantially the same flow rate, after which the divided liquid refrigerants flow toward the inter-heat-medium heat exchanger 14*a* and inter-heat-medium heat exchanger 14*b*. That is, the liquid refrigerants divided so as to have substantially the same flow rate pass through the expansion devices 15*c* and 15*d*, where their pressures are reduced, and enter the inter-heat-medium heat exchangers 14*a* and 14*b* as gas-liquid two-phase refrigerants at low temperature and low pressure. Since the inter-heat-medium heat exchangers 14*a* and 14*b* function as an evaporator for the refrigerant, the refrigerants passing through the inter-heat-medium heat exchangers 14*a* and 14*b* cool the heat media that are targets to be subjected to heat exchange (dissipate heat to the heat media), and exit as low-pressure liquid refrigerants. The gas refrigerants that have exited pass through the switching devices 24*a* and 24*b* join together, and the combined refrigerant passes through the refrigerant pipe 4 and exits the heat medium converter 3.

The refrigerant that has entered the heat source unit 1 passes through the check valve 13*d*, further passes through the four-way valve 11 and accumulator 16, and is then sucked into the compressor again.

(Cooling-Main Operation)

In cooling-main operation, the inter-heat-medium heat exchanger 14*a* functions as a condenser and the inter-heat-medium heat exchanger 14*b* functions as an evaporator. In cooling-main operation, the switching devices 24*a* and 23*b* are closed, and the opening-degree of the expansion device 22 is set in advance so as to prevent the refrigerant from flowing. The gas refrigerant that has entered the heat medium converter 3 and separated in the gas-liquid separator 20 passes through the switching device 23*a* and enters the inter-heat-medium heat exchanger 14*a*. Since the inter-heat-medium heat exchanger 14*a* functions as a condenser for the refrigerant, the refrigerant passing through the inter-heat-medium heat exchanger 14*a* heats the heat medium that is a target to be subjected to heat exchange, and is liquefied (dissipates heat to the heat medium). The liquid refrigerant that has passed through the inter-heat-medium heat exchanger 14*a* then passes through the expansion device 15*c*.

The liquid refrigerant passes through the expansion device 21 and joins with the liquid refrigerant that has passed through the inter-heat-medium heat exchanger 14*a* and expansion device 15*c*, and the combined refrigerant enters the expansion device 15*d*. The pressure of the liquid refrigerant that has entered the expansion device 15*d* is reduced by the expansion device 15*d*, and the refrigerant enters the inter-heat-medium heat exchanger 14*b* as a gas-liquid two-phase refrigerant at low temperature and low pressure. Since the inter-heat-medium heat exchanger 14*b* functions as an evaporator for the refrigerant, the refrigerant passing through the inter-heat-medium heat exchanger 14*a* cools the heat medium that is a target to be subjected to heat exchange, and is liquefied (absorbs heat from the heat medium). The refrigerant that has passed through the switching device 24*b* passes through the refrigerant pipe 4 and exits the heat medium converter 3.

The refrigerant that has entered the heat source unit 1 passes through the check valve 13*d*, further passes through the four-way valve 11 and accumulator 16, and is then sucked into the compressor again.

As described above, when the inter-heat-medium heat exchangers 14*a* and 14*b* are placed in parallel in the circuit on the heat source side (circuit on the refrigerant side), high-temperature gas refrigerants flow in both the inter-heat-medium heat exchangers 14*a* and 14*b* during heating only operation, so the heat medium exit temperatures of both the inter-heat-medium heat exchangers 14*a* and 14*b* can be raised. In both heating only operation and cooling only operation, the amount of refrigerant that enters the inter-heat-medium heat exchanger 14*a* and the amount of refrigerant that enters the inter-heat-medium heat exchanger 14*b* can be set to about half of the total amount of refrigerant, so a pressure loss can be reduced. Furthermore, in simultaneous operation of cooling and heating, the amount of refrigerant that enters the inter-heat-medium heat exchanger 14*a* and the amount of refrigerant that enters the inter-heat-medium heat exchanger 14*b* can be controlled.

Figure 9:
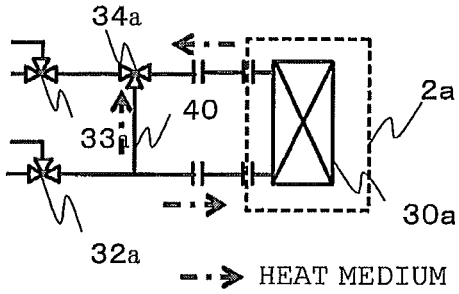
FIG. 9 is a system circuit diagram showing another embodiment of a heat medium flow rate adjusting device.

In the circuit on the heat medium side in Embodiments 1 to 3 above, the amount of heat medium that enters one indoor unit 2 is adjusted by its corresponding heat medium flow rate adjusting device 34*a*, 34*b*, 34*c*, or 34*d*. However, the structure shown in FIG. 9 may be used instead. In the example in FIG. 9, the use-side heat exchanger 30*a* is used, but any of the other use-side heat exchangers 30*b*, 30*c*, and 30*d* may be used instead. As shown in FIG. 9, a bypass pipe 40 is provided to enable the heat medium to bypass the use-side heat exchanger 30*a*, and the heat medium flow rate adjusting devices 34*a*, which is a three-way valve, for example, is disposed at the heat medium outlets of the bypass pipe 40 and use-side heat exchanger 30*a*. In this case, part of the heat medium that passes through the heat medium flow path switching device 32*a* and flows toward the inlet of the use-side heat exchanger 30*a* is made to flow in the bypass pipe 40 to make a bypass to the outlet of the use-side heat exchanger 30*a*. The amount of heat medium that enters the use-side heat exchanger 30*a* can be adjusted by adjusting the amount of heat medium flowing in the bypass pipe 40.

In the refrigerant circuit, which constitutes the heat source side in Embodiments 1 to 3 above, besides hydrofluorocarbon and other refrigerants from which a large amount of heat can be obtained by using a phase change between a vapor phase and a liquid phase, carbon dioxides and other refrigerants that can be placed in a supercritical state during usage, for example. In this case, the heat source-side heat exchanger 12 functions as a gas cooler in cooling only operation and cooling-main operation. The inter-heat-medium heat exchanger 14 indicated as a condenser also functions as a gas cooler and heats the heat medium. Since the refrigerant in the supercritical state is not separated into two phases of a gas and a liquid, the gas-liquid separator 20 does not need to be provided.

Although, in Embodiments 1 to 3 above, the refrigerating cycle circuit has been used as the heat source, other various types of heat sources including a heater can also be used.

INDUSTRIAL APPLICALBILITY

As described above, the present invention is useful for an air conditioning apparatus that uses a heat medium such as water or an antifreeze liquid as a secondary medium.

REFERENCE SIGNS LIST

1 heat source unit (outdoor unit), 2*a*, 2*b*, 2*c*, 2*d* indoor unit, 3 heat medium converter, 4 refrigerant pipe, 5 heat medium pipe, 10 compressor, four-way valve (refrigerant flow path switching device), 12 heat source-side heat exchanger, 13*a*, 13*b*, 13*c*, 13*d* check valve, 14*a*, 14*b* inter-heat-medium heat exchanger, 15*a*, 15*b*, 15*c*, 15*d* expansion device, 16 accumulator, 20 gas-liquid separator, 21, 22 expansion device, 23*a*, 23*b*, 24*a*, 24*b* switching device, 30*a*, 30*b*, 30*c*, 30*d* use-side heat exchanger, 31*a*, 31*b* pump (heat medium feeding unit), 32*a*, 32*b*, 32*c*, 32*d*, 33*a*, 33*b*, 33*c*, 33*d* heat medium flow rate adjusting device, 34*a*, 34*b*, 34*c*, 34*d* heat medium flow rate adjusting device, 35*a*, 35*b*, 35*c*, 35*d*, 36*a*, 36*b*, 36*c*, 36*d* heat medium temperature detecting means, outside air temperature detecting means, 40 heat medium bypass pipe, 50 controller, 61*a*, 61*b* heat medium feeding pipe, 62*a*, 62*b* heat medium return pipe

The invention claimed is:

1. An air conditioning apparatus comprising:

a plurality of use-side heat exchangers;

a heating inter-heat-medium heat exchanger and a cooling inter-heat-medium heat exchanger that exchange heat between a heat medium circulated in a heat medium circulating circuit including at least one of the use-side heat exchangers and a heat source fluid fed from a heat source unit to respectively heat and cool the heat medium;

a heat medium feeding unit corresponding to each of the inter-heat-medium heat exchangers;

outside air temperature detecting means for detecting outside air temperature; and a controller that controls the flow path of the heat medium, the air conditioning apparatus configured to simultaneously operate cooling and heating in which each of the use-side heat exchangers connects to either the heating inter-heat-medium heat exchanger or the cooling inter-heat-medium heat exchanger and in which the heating inter-heat-medium heat exchanger and the cooling inter-heat-medium heat exchanger operate simultaneously, wherein:

the controller compares the outside air temperature detected by the outside air temperature detecting means with a predetermined temperature at a preset time, preheats part of the plurality of use-side heat exchangers by driving the heat medium feeding unit connected to the heat medium circulating circuit corresponding with the part thereof to perform heat-up operation of the heat medium for the part of the plurality of use-side heat exchangers when the outside air temperature is lower than the first predetermined temperature, and selects the use-side heat exchangers to be preheated out of all the use-side heat exchangers in descending order of length of a heat medium pipe between each of the use-side heat exchangers and a unit including the heating inter-heat-medium heat exchanger.

2. The air conditioning apparatus of claim 1, wherein the controller precools part of the plurality of use-side heat exchangers by driving the heat medium feeding unit connected to the heat medium circulating circuit corresponding with the part thereof to perform cool-down operation of the heat medium of the part of the plurality of use-side heat exchangers when the outside air temperature is higher than the second predetermined temperature.

3. The air conditioning apparatus of claim 2, wherein the controller selects the use-side heat exchangers to be precooled out of all the use-side heat exchangers in descending order of length of a heat medium pipe between each of the use-side heat exchangers and a unit including the cooling inter-heat-medium heat exchanger.

4. The air conditioning apparatus of claim 2, wherein the controller, when an operation for heating is commanded and a use-side heat exchanger which is commanded is not yet preheated, exchanges heat media between the commanded use-side heat exchanger and a use-side heat exchanger that has been preheated, and when an operation for cooling is commanded and a use-side heat exchanger which is commanded is not yet precooled, exchanges heat media between the commanded use-side heat exchanger and a use-side heat exchanger that has been precooled.

5. The air conditioning apparatus of claim 2, wherein preheating is carried out again when the temperature of the preheated heat medium drops due to heat dissipation upon elapse of a predetermined time after preheating, and precooling is carried out again when the temperature of the precooled heat medium rises due to heat absorption upon elapse of a predetermined time after precooling.

6. The air conditioning apparatus of claim 2, wherein the controller sets preheating or precooling start time.

7. The air conditioning apparatus of claim 2, wherein a remote controller connected to an indoor unit having at least one of use-side heat exchangers is usable to specify the time to start preheating or precooling, or to cancel preheating or precooling.

8. The air conditioning apparatus of claim 1, further comprising a refrigerating cycle circuit that connects a compressor, a heat source-side heat exchanger, a first expansion device, the heating inter-heat-medium heat exchanger and the cooling inter-heat-medium heat exchanger with piping, in which a refrigerant circulates.

9. The air conditioning apparatus of claim 8, further comprising a second expansion device provided between the heating inter-heat-medium heat exchanger and the cooling inter-heat-medium heat exchanger.

10. The air conditioning apparatus of claim 1, wherein a main ingredient of the heat medium is water.

11. The air conditioning apparatus of claim 8, wherein the refrigerant that circulates in the refrigerating cycle circuit is a refrigerant that is in a supercritical state depending on a use condition.

12. An air conditioning apparatus, comprising:

a plurality of use-side heat exchangers;

a heating inter-heat-medium heat exchanger and a cooling inter-heat-medium heat exchanger that exchange heat between a heat medium circulated in a heat medium circulating circuit including at least one of the use-side heat exchangers and a heat source fluid fed from a heat source unit to respectively heat and cool the heat medium;

a heat medium feeding unit corresponding to each of the inter-heat-medium heat exchangers;

outside air temperature detecting means for detecting outside air temperature; and a controller that controls the flow path of the heat medium, the air conditioning apparatus capable for simultaneous operation of cooling and heating in which each of the use-side heat exchangers connects either the heating inter-heat-medium heat exchanger or the cooling inter-heat-medium heat exchanger and in which the heating inter-heat-medium heat exchanger and the cooling inter-heat-medium heat exchanger operate simultaneously, wherein:

the controller compares the outside air temperature detected by the outside air temperature detecting means with a predetermined temperature at a preset time, preheats part of the plurality of use-side heat exchangers by driving the heat medium feeding unit connected to the heat medium circulating circuit corresponding with the part thereof to perform heat-up operation of the heat medium for the part of the plurality of use-side heat exchangers when the outside air temperature is lower than the first predetermined temperature, and precools part of the plurality of use-side heat exchangers by driving the heat medium feeding unit connected to the heat medium circulating circuit corresponding with the part thereof to perform cool-down operation of the heat medium of the part of the plurality of use-side heat exchangers when the outside air temperature is higher than the second predetermined temperature, wherein the air conditioning apparatus further comprises a plurality of first heat medium flow path switching devices that are provided on the respective heat medium inlets sides of the use-side heat exchangers and switch between a flow path connecting the heating inter-heat-medium heat exchanger and the respective heat medium inlets of the use-side heat exchangers and a flow path connecting the cooling inter-heat-medium heat exchanger and the respective heat medium inlets of the use-side heat exchangers respectively; and a plurality of second heat medium flow path switching devices that are provided on the respective heat medium outlet sides of the use-side heat exchangers and switch between a flow path connecting the heating inter-heat-medium heat exchanger and the respective heat medium outlets of the use-side heat exchangers and a flow path connecting the cooling inter-heat-medium heat exchanger and the respective heat medium outlets of the use-side heat exchangers respectively, and wherein the controller controls the first and second heat medium flow path switching devices so that the part of the plurality of use-side heat exchangers are connected to the heating inter-heat-medium heat exchanger or the cooling inter-heat-medium heat exchanger to form the heat medium circulating circuit when preheating or precooling.

13. An air conditioning apparatus comprising:

a plurality of use-side heat exchangers;

a heating inter-heat-medium heat exchanger and a cooling inter-heat-medium heat exchanger that exchange heat between a heat medium circulated in a heat medium circulating circuit including at least one of the use-side heat exchangers and a heat source fluid fed from a heat source unit to respectively heat and cool the heat medium;

a heat medium feeding unit corresponding to each of the inter-heat-medium heat exchangers;

outside air temperature detecting means for detecting outside air temperature; and a controller that controls the flow path of the heat medium, the air conditioning apparatus configured to simultaneously operate cooling and heating in which each of the use-side heat exchangers connects either the heating inter-heat-medium heat exchanger or the cooling inter-heat-medium heat exchanger and in which the heating inter-heat-medium heat exchanger and the cooling inter-heat-medium heat exchanger operate simultaneously, wherein:

the controller compares the outside air temperature detected by the outside air temperature detecting means with a predetermined temperature at a preset time and preheats part of the plurality of use-side heat exchangers by driving the heat medium feeding unit connected to the heat medium circulating circuit corresponding with the part thereof to perform heat-up operation of the heat medium for the part of the plurality of use-side heat exchangers when the outside air temperature is lower than the first predetermined temperature, and wherein the air conditioning apparatus further comprises a refrigerating cycle circuit that connects a compressor, a heat source-side heat exchanger, a first expansion device, the heating inter-heat-medium heat exchanger and the cooling inter-heat-medium heat exchanger with piping, in which a refrigerant circulates, a second expansion device provided between the heating inter-heat-medium heat exchanger and the cooling inter-heat-medium heat exchanger, a heat source unit accommodating a compressor, a heat source-side heat exchanger, and a four-way valve;

a heat medium converter accommodating the first expansion device, the second expansion device, the heating inter-heat-medium heat exchanger, and the cooling inter-heat-medium heat exchanger, and a plurality of check valves provided in the heat source unit so that an order of a refrigerant flowing through the heating inter-heat-medium heat exchanger and the cooling inter-heat-medium heat exchanger is always the same.

14. An air conditioning apparatus comprising:

a plurality of use-side heat exchangers;

a heating inter-heat-medium heat exchanger and a cooling inter-heat-medium heat exchanger that exchange heat between a heat medium circulated in a heat medium circulating circuit including at least one of the use-side heat exchangers and a heat source fluid fed from a heat source unit to respectively heat and cool the heat medium;

a heat medium feeding unit corresponding to each of the inter-heat-medium heat exchangers;

outside air temperature detecting means for detecting outside air temperature;

a heat source unit accommodating a compressor, a heat source-side heat exchanger, a four-way valve, and an accumulator;

a heat medium converter accommodating a gas-liquid separator, the heating inter-heat-medium heat exchanger, the cooling inter-heat-medium heat exchanger, a first expansion device, and a second expansion device, a refrigerating cycle circuit in which a refrigerant circulates between the heat source unit and the heat medium converter, and a controller that controls the flow path of the heat medium, the air conditioning apparatus configured to simultaneously operate cooling and heating in which each of the use-side heat exchangers connects either the heating inter-heat-medium heat exchanger or the cooling inter-heat-medium heat exchanger and in which the heating inter-heat-medium heat exchanger and the cooling inter-heat-medium heat exchanger operate simultaneously, wherein:

the controller compares the outside air temperature detected by the outside air temperature detecting means with a predetermined temperature at a preset time, preheats part of the plurality of use-side heat exchangers by driving the heat medium feeding unit connected to the heat medium circulating circuit corresponding with the part thereof to perform heat-up operation of the heat medium for the part of the plurality of use-side heat exchangers when the outside air temperature is lower than the first predetermined temperature, and wherein the refrigerant which has entered the heat medium converter from the heat source unit is made to flow in parallel into a first side having the heating inter-heat-medium heat exchanger and the first expansion device and into a second side having the cooling inter-heat-medium heat exchanger and the second expansion device, or part of the refrigerant which has entered the heat medium converter from the heat source unit is made to flow into the first side and the second side in series and the remainder is made to flow into the first side or the second side.

15. The air conditioning apparatus of claim 14, wherein the refrigerant that circulates in the refrigerating cycle circuit is a refrigerant that is in a supercritical state depending on a use condition.

* * * * *